US008053402B2

(12) United States Patent
Bianchetti et al.

(10) Patent No.: US 8,053,402 B2
(45) Date of Patent: Nov. 8, 2011

(54) BLEACHING COMPOSITIONS CONTAINING PERFUME MICROCAPSULES AND A STABILIZING AGENT

(75) Inventors: Giulia Ottavia Bianchetti, Rome (IT); Marc Francois Theophile Evers, Strombeek-Bever (BE); Johan Smets, Lubbeek (BE); Giovanni Grande, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/687,357

(22) Filed: Jan. 14, 2010

(65) Prior Publication Data

US 2010/0180387 A1 Jul. 22, 2010

(30) Foreign Application Priority Data

Jan. 16, 2009 (EP) ..... 09150730
Dec. 11, 2009 (EP) ..... 09178791

(51) Int. Cl.
*C11D 3/50* (2006.01)
*C11D 3/395* (2006.01)

(52) U.S. Cl. ..... 510/286; 510/276; 510/302; 510/101; 510/309; 510/349; 510/367; 510/372; 510/375; 510/441

(58) Field of Classification Search ..... 510/276, 510/286, 302, 101, 309, 349, 367, 372, 375, 510/441
See application file for complete search history.

(56) References Cited

U.S. PATENT DOCUMENTS

| | | | | |
|---|---|---|---|---|
| 3,812,044 | A | 5/1974 | Connor et al. | |
| 4,145,184 | A | 3/1979 | Brain et al. | |
| 4,152,272 | A | 5/1979 | Young | |
| 4,209,417 | A | 6/1980 | Whyte | |
| 4,259,201 | A | 3/1981 | Cockrell, Jr. et al. | |
| 4,515,705 | A | 5/1985 | Moeddel | |
| 4,704,233 | A | 11/1987 | Hartman et al. | |
| 4,818,425 | A | 4/1989 | Meijer et al. | |
| 5,441,660 | A | 8/1995 | Tsaur et al. | |
| 5,616,281 | A | 4/1997 | Hardy et al. | |
| 6,653,269 | B2 | 11/2003 | Housmekerides et al. | |
| 6,890,475 | B1 | 5/2005 | Hatjasalo et al. | |
| 2003/0012222 | A1 | 1/2003 | Rinchiuso | |
| 2004/0071742 | A1 | 4/2004 | Popplewell et al. | |
| 2006/0258557 | A1 | 11/2006 | Popplewell et al. | |
| 2007/0082829 | A1* | 4/2007 | Smets et al. | 510/101 |
| 2008/0118568 | A1 | 5/2008 | Smets et al. | |
| 2009/0217464 | A1* | 9/2009 | Souter et al. | 8/137 |
| 2009/0312221 | A1* | 12/2009 | Lant et al. | 510/320 |

FOREIGN PATENT DOCUMENTS

| | | |
|---|---|---|
| CA | 2 291 871 | 6/2000 |
| EP | 1 396 536 A1 | 3/2004 |
| EP | 1 396 536 B1 | 10/2005 |

OTHER PUBLICATIONS

International Search Report, International Application No. PCT/US2010/020619, mailed Mar. 26, 2010, 4 pages.

* cited by examiner

*Primary Examiner* — Charles Boyer

(74) *Attorney, Agent, or Firm* — Andrew J. Mueller; James F. McBride; Leonard W. Lewis

(57) ABSTRACT

Liquid compositions, which are chemically and physically stable, comprising peroxygen bleach, a crystalline hydroxyl-containing stabilizing agent, perfume microcapsules and more than 10% of surfactant by weight of the total composition. The perfumes microcapsules, preferably, comprise a polymeric outer shell made of the condensation of melamine and formaldehyde. Process for laundering fabrics comprising the step of contacting the fabrics with said bleaching compositions.

9 Claims, 1 Drawing Sheet

A

B

BLEACHING COMPOSITIONS CONTAINING PERFUME MICROCAPSULES AND A STABILIZING AGENT

FIELD OF THE INVENTION

The present invention relates to bleaching compositions, more particularly to peroxygen bleach-containing compositions comprising perfume microcapsules.

BACKGROUND OF THE INVENTION

Peroxygen bleach-containing compositions have been extensively described in laundry applications as laundry detergents, laundry additives or even laundry pretreaters. Many bleach compositions, including peroxygen bleach-containing compositions, comprise a perfume for the purpose of delivering a pleasant smell in addition to the whitening performance; but also for the purpose of improving the overall consumer acceptance of bleaching compositions.

Indeed, nowadays, having a good perfume is of such importance for consumers that some compositions might have as a main purpose to impart a pleasant smell to laundry. Therefore, it would be a significant advancement in the art to provide a composition which gives a pleasant smell to laundry in addition to excellent whitening and cleaning performances. However, the incorporation of some ingredients, such as perfumes, into conventional bleaching compositions has always been problematic due to the tendency of bleaching compositions to chemically react with these specific ingredients.

Most of the time, the addition of these compounds leads bleaching compositions to be unstable. More particularly, such bleaching composition will be chemically unstable: the active ingredients will have the tendency to diminish upon time, leading therefore to a less efficient composition. This effect is particularly significant in the case of incorporation of perfume. The perfume will react with the bleaching component upon storage and will result in compositions which do not have the desired benefit, i.e., the delivery of a good perfume to the laundry treated thereby.

Several different methods have been used to overcome this problem. One of these methods, in view of introducing perfumes in detergent and bleaching compositions, is the use of microcapsules and/or compounds in a form of particles with perfumes encapsulated therein. The following documents are representative of the prior art available on bleaching composition comprising perfume microcapsules:

WO 00/032735, published on Jun. 8, 2000, discloses a bleaching formulation containing perfume in a microencapsulated form.

US 2003/012222, published on Jul. 3, 2003, relates to detergents and cleaning agents comprising capsules having a core of a hydrophobic material which encloses at least one perfume.

However, the addition to bleaching compositions of such microcapsules and/or compounds in a form of particles, has a tendency to lead to products which are physically unstable. Indeed, these bleaching compositions will have the tendency to sediment and/or settle out, especially during storage and/or transportation. Furthermore, the addition to bleaching compositions of such microcapsules and/or compounds in a form of particles, will often result in compositions which are not homogenous and/or in compositions forming layer at its surfaces.

Accordingly, there is a need to formulate bleaching compositions having stably suspended perfume microcapsules.

The present invention provides, therefore, a stable bleaching composition which, in the same time, delivers a good perfume to the laundry treated thereby and which have excellent bleaching performance.

SUMMARY OF THE INVENTION

The present invention fulfils the needs identified above by providing a liquid composition comprising peroxygen bleach, perfume microcapsules a crystalline, hydroxyl-containing stabilizing agent and more than 10% of surfactant by weight of the total composition. The microcapsules of the present invention comprise, preferably, a polymeric outer shell made of the condensation of melamine and formaldehyde.

Surprisingly, it has been found that by incorporating the microcapsules of the present invention in a peroxygen bleaching composition comprising a crystalline, hydroxyl-containing stabilizing agent and more than 10% of surfactant by weight of the total composition, the perfume microcapsule can be stably suspended.

By stably suspending the microcapsules in the bleaching products, the perfume microcapsules within the bleaching composition have a reduced tendency to sediment and/or settle out of the products during storage and/or transportation.

As a result of the microcapsules having a reduced tendency to sediment and/or settle out of the bleaching composition products, consumers have more consistent perfumes which will be deposited on the laundry treated thereby. Further, as a result of the microcapsules having a reduced tendency to sediment and/or settle out of the bleaching composition products, the appearance of the product will stay homogenous.

In another aspect, the present invention relates also to a process for laundering fabrics comprising the step of contacting the fabrics with the bleaching compositions of the present invention.

DETAILED DESCRIPTION OF THE INVENTION

Figure 1:
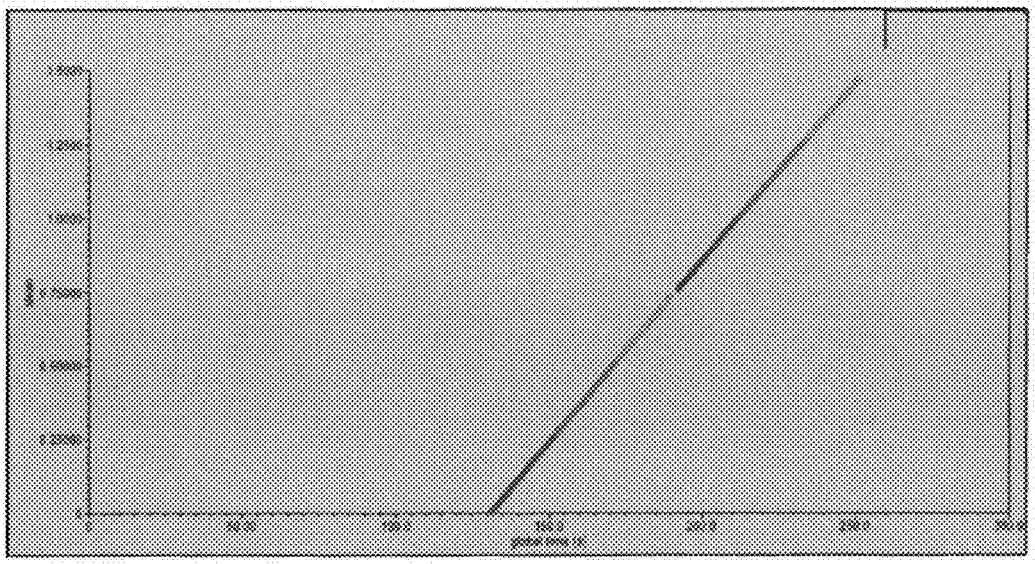
FIG. 1 shows the rheology profiles of a liquid composition without any crystalline hydroxyl-containing stabilizing agent (A) and a liquid composition with a crystalline hydroxyl-containing stabilizing agent (B).
Figure 1:
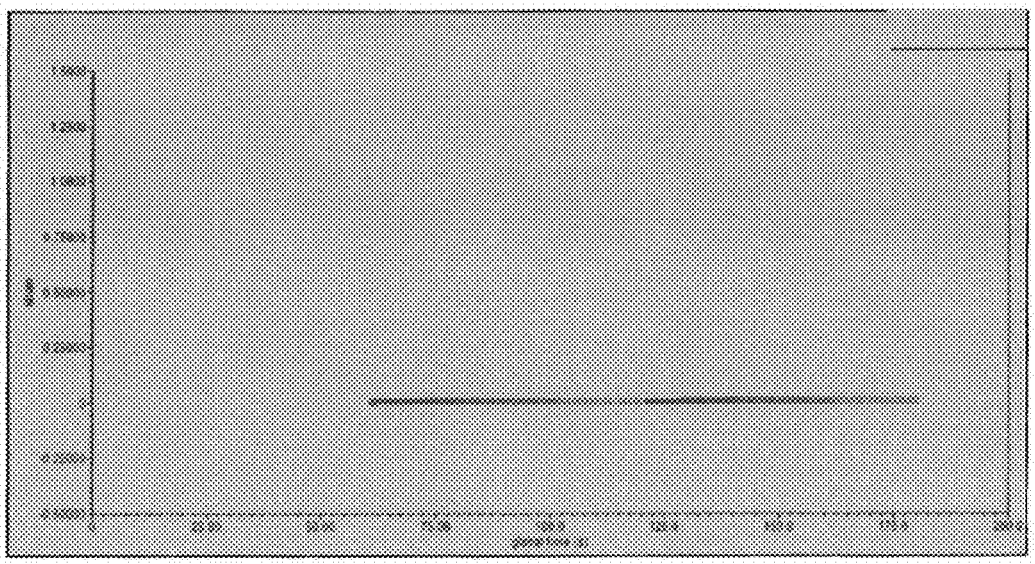

The present invention relates to liquid composition comprising peroxygen bleach, perfume microcapsules, a crystalline hydroxyl-containing stabilizing agent and more than 10% of surfactant by weight of the total composition.

The bleaching compositions of the present invention are chemically stable and physically stable. By "chemically stable", it is meant that the composition will have limited perfume leakage and that the active ingredients, contained in said composition, such as the perfume, will not have the tendency to disappeared upon time.

Furthermore, by "chemically stable", it is meant also herein that there is virtually no chemical changes of the different ingredients due to reaction between them. It is meant also that said compositions of the present invention comprising peroxygen bleach do not undergo more than 20% available oxygen loss at 50° C. in 2 weeks. Chemical stability of the compositions herein may be evaluated by measuring the concentration of available oxygen at given storage time after having manufactured the compositions. The concentration of available oxygen can be measured by chemical titration methods known in the art, such as the iodimetric method, the permanganometric method and the cerimetric method. Said methods and the criteria for the choice of the appropriate method are described for example in "Hydrogen Peroxide", W. C. Schumb, C. N. Satterfield and R. L. Wentworth, Reinhold Publishing Corporation, New York, 1955 and "Organic Peroxides", Daniel Swern, Editor Wiley Int. Science, 1970. Alternatively, the chemical stability of said compositions may also be evaluated by visually observing bulging of the container or bottle containing it.

The bleaching compositions of the present invention are physically stable. By "physically stable" it is meant herein that the compositions of the present invention do not split in two or more phases when exposed in stressed conditions, e.g., at a temperature of 40° C. during 2 weeks. By "physically stable", it is meant also that the compositions of the invention do not sediment and/or settle out, especially during storage and/or transportation. Furthermore, it means also that the microcapsules will remain in suspension in the composition, the product will thus stay homogenous.

The Liquid Compositions

The bleaching composition according to the present invention is formulated as a liquid composition. By "liquid" it is meant to include liquids, gels and pastes.

The bleaching compositions herein are preferably, but not necessarily, formulated as aqueous compositions. Liquid bleaching compositions are preferred herein for convenience of use. Preferred liquid bleaching compositions of the present invention are aqueous and therefore, preferably may comprise water, more preferably may comprise water in an amount of from 60% to 98%, even more preferably of from 80% to 97% and most preferably 85% to 97% by weight of the total composition.

In a preferred embodiment the liquid compositions according to the present invention are formulated in the neutral to the acidic pH range, i.e. the pH of the present composition is preferably between 5 and 9, more preferably between 6 and 8 when measured at 25° C. on neat composition. It is within this neutral to acidic pH range that the optimum chemical stability and bleaching and/or cleaning performance of the peroxygen bleach are obtained.

More precisely, the pH of the liquid bleaching compositions herein, as is measured at 25° C. on neat product, preferably is at least, with increasing preference in the order given, 0.1, 0.5, 1, 1.5, 2, 2.5, 3, 3.5, 4, 4.5 or 5.

Independently, the pH of the liquid bleaching compositions herein, as is measured at 25° C. on neat product, preferably is no more than, with increasing preference in the order given, 9, 8.5, 8, 7.5, 7, 6.5, 6 or 5.5.

Accordingly, the compositions herein may further comprise an acid or a base to adjust the pH as appropriate. Preferred acids herein are organic or inorganic acids or mixtures thereof. Preferred organic acids are acetic acid, citric acid or a mixture thereof. Preferred inorganic acids are sulfuric acid, phosphoric acid or a mixture thereof. A particularly preferred acid to be used herein is an inorganic acid and most preferred is sulfuric acid. Typical levels of such acids, when present, are of from 0.01% to 3.0%, preferably from 0.05% to 2.0% and more preferably from 0.1% to 1.0% by weight of the total composition. The bases to be used herein can be organic or inorganic bases. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide. Other suitable bases include ammonia, ammonium carbonate and hydrogen carbonate. Typical levels of such bases, when present, are of from 0.01% to 1.0%, preferably from 0.05% to 0.8% and more preferably from 0.1% to 0.5% by weight of the total composition.

Peroxygen Bleach

As an essential element the bleaching compositions according to the present invention comprise peroxygen bleach. The presence of peroxygen bleach providing excellent bleaching and cleaning benefits.

Suitable peroxygen bleaches to be used herein are, preferably, selected from the group consisting of: hydrogen peroxide; water soluble sources of hydrogen peroxide; organic or inorganic peracids; hydroperoxides; diacyl peroxides; and mixtures thereof. As used herein a hydrogen peroxide source refers to any compound that produces perhydroxyl ions on contact with water.

Suitable water-soluble sources of hydrogen peroxide for use herein include percarbonates, perborates and persilicates and mixtures thereof.

Suitable diacyl peroxides for use herein include aliphatic, aromatic and aliphatic-aromatic diacyl peroxides, and mixtures thereof.

Suitable aliphatic diacyl peroxides for use herein are dilauroyl peroxide, didecanoyl peroxide, dimyristoyl peroxide, or mixtures thereof. Suitable aromatic diacyl peroxide for use herein is for example benzoyl peroxide. Suitable aliphatic-aromatic diacyl peroxide for use herein is for example lauroyl benzoyl peroxide.

Suitable organic or inorganic peracids for use herein include: persulphates such as monopersulfate; peroxyacids such as diperoxydodecandioic acid (DPDA); magnesium perphthalic acid; perlauric acid; phthaloyl amidoperoxy caproic acid (PAP); perbenzoic and alkylperbenzoic acids; and mixtures thereof.

Suitable hydroperoxides for use herein are tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide and mixtures thereof. Such hydroperoxides have the advantage of being particularly safe to fabrics and color while delivering excellent bleaching performance when used in any laundry application.

A preferred peroxygen bleach herein is selected from the group consisting of: hydrogen peroxide; water-soluble sources of hydrogen peroxide; organic or inorganic peracids; hydroperoxides; and diacyl peroxides; and mixtures thereof.

A more preferred peroxygen bleach herein is selected from the group consisting of hydrogen peroxide, water-soluble sources of hydrogen peroxide and diacyl peroxides and mixtures thereof. An even more preferred peroxygen bleach herein is selected from the group consisting of hydrogen peroxide, water soluble sources of hydrogen peroxide, aliphatic diacyl peroxides, aromatic diacyl peroxides and aliphatic-aromatic diacyl peroxides and mixtures thereof. The most preferred peroxygen bleach herein is hydrogen peroxide, water-soluble sources of hydrogen peroxide or mixtures thereof.

The liquid compositions according to the present invention comprise from 0.1% to 30% by weight of the total composition of said peroxygen bleach. Preferably, the bleaching composition herein may comprise from 1% to 20%, preferably from 2% to 15%, more preferably from 3% to 10% by weight of the total composition of said peroxygen bleach.

The presence of peroxygen bleach in bleaching compositions according to the present invention contributes to the excellent bleaching and/or cleaning performance on various types of soils including on spot stains like bleachable stains (e.g., coffee, beverage, food) of the compositions of the present invention. Furthermore, peroxygen bleaches are chosen herein as oxidising agents over other oxidising agents, as for example hypohalite bleaches, as they are considered as being safer to fabrics, specifically to coloured fabrics.

By "bleachable stains" it is meant herein any soils or stains containing ingredients sensitive to bleach that can be found on any carpet, e.g., coffee or tea.

The Perfume Microcapsule

The liquid compositions of the present invention comprise as an essential ingredient a perfume microcapsule. By "perfume microcapsule", it is meant, herein, a perfume that is encapsulated in a microcapsule.

The perfume microcapsule of the present invention comprises a core material, which enclosed at least one perfume, and a wall material, the shell, that at least partially surrounds said core material.

The wall material of the present invention has a certain combination of physical and chemical characteristics. The physical and chemical characteristics of the capsules shell are fracture strength, particle size, particle wall thickness and perfume microcapsule leakage. This physical and chemical characteristics can be evaluated by the techniques and process commonly used by the skilled person in the art. Therefore, as tested in accordance with applicants test methods, at least 75%, 85% or even 90% of said microcapsule have a fracture strength of from 0.2 MPa to 10 MPa, from 0.4 MPa to 5 MPa, from 0.6 MPa to 3.5 MPa, or even from 0.7 MPa to 3 MPa; and a microcapsule leakage of from 0% to 30%, from 0% to 20%, or even from 0% to 5%. In one aspect of the present invention, at least 75%, 85% or even 90% of said perfume microcapsule have a particle size of from 1 microns to 80 microns, 5 microns to 60 microns, from 10 microns to 50 microns, or even from 15 microns to 40 microns.

In one other aspect of the present invention, at least 75%, 85% or even 90% of said microcapsule have a wall thickness of from 60 nm to 250 nm, from 80 nm to 180 nm, or even from 100 nm to 160 nm.

In one embodiment of the invention, the wall material of the microcapsules comprises a suitable resin including the reaction product of an aldehyde and an amine. According to the present invention, suitable aldehydes include formaldehyde; and suitable amines include melamine, urea, benzoguanamine, glycoluril, and mixtures thereof. Suitable melamines include, methylol melamine, methylated methylol melamine, imino melamine and mixtures thereof. Suitable ureas include, dimethylol urea, methylated dimethylol urea, urea-resorcinol, and mixtures thereof. Suitable materials for making may be obtained from one or more of the following companies Solutia Inc. (St Louis, Mo. U.S.A.), Cytec Industries (West Paterson, N.J. U.S.A.), sigma-Aldrich (St. Louis, Mo. U.S.A.).

In a preferred embodiment of the present invention, the wall of the microcapsule is made of the condensation of melamine and formaldehyde.

In one aspect of the invention, the core of the perfume microcapsule comprises a material selected from the group consisting of a perfume raw material.

In one aspect of the present invention, said perfume microcapsule comprise, based on total particle weight, from 20% to 95%, from 50% to 90%, from 70% to 85%, or even from 80% to 85% by weight of a perfume composition.

Suitable perfumes for use herein include materials which provide an olfactory aesthetic benefit and/or help to cover any "chemical" odour that the product may have. By perfume is meant, thus, any substance which has the desired olfactory property. Such substances include all fragrances or perfumes that are commonly used in perfumery or in laundry detergent or cleaning product compositions.

Such perfume may have a natural, semi-synthetic or synthetic origin. Preferably, perfumes are selected form the class of substance comprising the hydrocarbons, aldehydes or esters.

The perfume of the present invention also include natural extracts and/or essences, which may comprise complex mixtures of constituents, such as orange oil, lemon oil, rose extract, lavender, musk, patchouli, balsam essence, sandalwood oil, pine oil, and cedar oil. The perfumes, according to the present invention, can be used as single substances or in a mixture with one another.

The core of the microcapsules may thus comprise only perfume as the sole hydrophobic material or, alternatively, the core of the microcapsules may, in addition to the perfume, include a further hydrophobic material in which the perfume is dissolved or dispersed.

The hydrophobic materials, which can be used as core material in addition to the fragrance or perfume, include all types of oils, such as vegetable oils, animal oils, mineral oils, paraffins, chloroparaffins, fluorocarbons, and other synthetic oils.

Such material may be selected from the group consisting of vegetable oil, including neat and/or blended vegetable oils including caster oil, coconut oil, cottonseed oil, grape oil, rapeseed, soybean oil, corn oil, palm oil, linseed oil, safflower oil, olive oil, peanut oil, coconut oil, palm kernel oil, castor oil, lemon oil and mixtures thereof; esters of vegetable oils, esters, including dibutyl adipate, dibutyl phthalate, butyl benzyl adipate, benzyl octyl adipate, tricresyl phosphate, trioctyl phosphate and mixtures thereof; straight or branched chain hydrocarbons, including those straight or branched chain hydrocarbons having a boiling point of greater than 80° C.; partially hydrogenated terphenyls, dialkyl phthalates, alkyl biphenyls, including monoisopropylbiphenyl, alkylated naphthalene, including dipropylnaphthalene, petroleum spirits, including kerosene, mineral oil and mixtures thereof; aromatic solvents, including benzene, toluene and mixtures thereof; silicone oils; and mixtures thereof.

The perfume ingredients and compositions suitable to be used herein are the conventional ones known in the art. Selection of any perfume component, or amount of perfume, is mainly based on aesthetic considerations.

Suitable perfume compounds and compositions can be found in the art including U.S. Pat. No. 4,145,184, Brain and Cummins, issued Mar. 20, 1979; U.S. Pat. No. 4,209,417, Whyte, issued Jun. 24, 1980; U.S. Pat. No. 4,515,705, Moeddel, issued May 7, 1985; and U.S. Pat. No. 4,152,272, Young, issued May 1, 1979.

Crystalline, Hydroxyl-Containing Stabilizing Agent

The liquid compositions of the present invention comprise, as an important ingredient, a crystalline, hydroxyl-containing, stabilizing agent. The presence of such agent provides, indeed, improved physical stability of the composition.

The crystalline, hydroxyl-containing stabilizing agent may be present, in the liquid compositions of the present invention, at a level of from 0.1% to 10%, more preferably from 0.1% to 3%, and most preferably from 0.3% to 2% by weight of the liquid composition.

Crystalline, hydroxyl-containing stabilizing agents can be fatty acid, fatty ester or fatty soap water-insoluble wax-like substance. The crystalline, hydroxyl-containing stabilizing agents, in accordance with the present invention, are preferably derivatives of castor oil, especially hydrogenated castor oil. In a more preferred embodiment, the crystalline, hydroxyl-containing stabilizing agents is castor wax.

In another embodiment of the present invention, the crystalline, hydroxyl-containing agent of the present invention is selected from the group consisting of:

i)

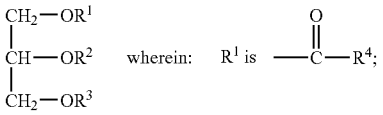

$R^2$ is $R^1$ or H; $R^3$ is $R^1$ or H; $R^4$ is independently $C_{10}$-$C_{22}$ alkyl or alkenyl comprising at least one hydroxyl group;

ii)

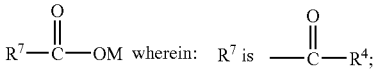

$R^4$ is as defined above in i); M is $Na^+$, $K^+$, $Mg^{++}$ or $Al^{3+}$, or H; and iii) mixtures thereof.

Alternatively, the crystalline, hydroxyl-containing stabilizing agent may have the formula:

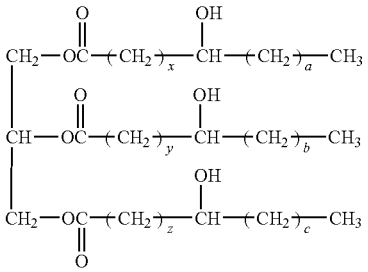

wherein: (x+a) is between 11 and 17; (y+b) is between 11 and 17; and (z+c) is between 11 and 17. Preferably, the crystalline, hydroxyl-containing stabilizing agent have the formula wherein x=y=z=10 and/or wherein a=b=c=5.

Commercially available crystalline, hydroxyl-containing stabilizing agents include Thixcin® from Rheox, Inc.

In addition to Thixcin®, alternative materials that are suitable for use as crystalline, hydroxyl-containing stabilizing agents include, but are not limited to, compounds of the formula:

$$Z—(CH(OH))_a—Z'$$

where a is from 2 to 4, preferably a is 2; Z and Z' are hydrophobic groups, especially selected from $C_6$-$C_{20}$ alkyl or cycloalkyl, $C_6$-$C_{24}$ alkaryl or aralkyl, $C_6$-$C_{20}$ aryl or mixtures thereof. Optionally, Z can contain one or more non-polar oxygen atoms as in ethers or esters. A non-limiting example of such alternative materials is 1,4-di-O-benzyl-D-Threitol in the R, R, and S, S forms and any mixtures, optically active or not.

Surfactants

The compositions of the present invention comprise as an essential ingredient surfactants or a mixture thereof.

The compositions will comprise from 10% to 40%, preferably from 12% to 30% and more preferably from 15% to 25% by weight of the total composition of a surfactant.

The presence of surfactants, in such specific amount, is necessary to provide excellent cleaning performance as well as a good physical stability of the composition.

Suitable surfactants for use herein include any nonionic, anionic, zwitterionic, cationic and/or amphoteric surfactants. Particularly suitable surfactants for use herein are nonionic surfactants such as alkoxylated nonionic surfactants and/or polyhydroxy fatty acid amide surfactants and/or amine oxides and/or zwitterionic surfactants like the zwitterionic betaine surfactants described herein after.

Suitable nonionic surfactants include alkoxylated nonionic surfactants. Preferred alkoxylated nonionic surfactants herein are ethoxylated nonionic surfactants according to the formula RO—$(C_2H_4O)$nH, wherein R is a $C_6$ to $C_{22}$ alkyl chain or a $C_6$ to $C_{28}$ alkyl benzene chain, and wherein n is from 0 to 20, preferably from 1 to 15 and, more preferably from 2 to 15 and most preferably from 2 to 12. The preferred R chains for use herein are the $C_8$ to $C_{22}$ alkyl chains. Propoxylated nonionic surfactants and ethoxy/propoxylated ones may also be used herein instead of the ethoxylated nonionic surfactants as defined herein above or together with said surfactants Preferred ethoxylated nonionic surfactants are substantially linear ethoxylated nonionic surfactants according to the above formula. By "linear" it is meant herein that the fatty alcohols used as a basis of the nonionic surfactant (raw material) at least 90%, preferably at least 95%, more preferably at least 97%, and most preferably 100% by weight of the total amount of fatty alcohols of linear (i.e., straight chain) fatty alcohols.

Suitable substantially linear ethoxylated nonionic surfactants for use herein are Marlipal® 24-7 (R is a mixture of linear $C_{12}$ and $C_{14}$ alkyl chains, n is 7), Marlipal® 24-4 (R is a mixture of linear $C_{12}$ and $C_{14}$ alkyl chains, n is 4), Marlipal® 24-3 (R is a mixture of linear $C_{12}$ and $C_{14}$ alkyl chains, n is 3), Marlipal® 24-2 (R is a mixture of linear $C_{12}$ and $C_{14}$ alkyl chains, n is 2), or mixtures thereof. Preferred herein are Marlipal® 24-7, Marlipal® 24-4, or mixtures thereof. These Marlipal® surfactants are commercially available from Condea.

Preferred ethoxylated nonionic surfactants are according to the formula above and have an HLB (hydrophilic-lipophilic balance) below 16, preferably below 15, and more preferably below 14. Those ethoxylated nonionic surfactants have been found to provide good grease cutting properties.

Accordingly suitable ethoxylated nonionic surfactants for use herein are Dobanol® or Lutensol® ethoxylated nonionic surfactant series. Preferred herein are Dobanol® 91-2.5, or Lutensol® TO3, or Lutensol® AO3, or Tergitol® 25L3, or Dobanol® 23-3, or Dobanol® 23-2, or Dobanol® 45-7, Dobanol® 91-8, or Dobanol® 91-10, or Dobanol® 91-12, or mixtures thereof. These Dobanol® surfactants are commercially available from SHELL. These Lutensol® surfactants are commercially available from BASF and these Tergitol® surfactants are commercially available from UNION CARBIDE.

Suitable chemical processes for preparing the alkoxylated nonionic surfactants for use herein include condensation of corresponding alcohols with alkylene oxide, in the desired proportions. Such processes are well known to the man skilled in the art and have been extensively described in the art.

Suitable zwitterionic betaine surfactants for use herein contain both a cationic hydrophilic group, i.e., a quaternary ammonium group, and anionic hydrophilic group on the same molecule at a relatively wide range of pH's. The typical anionic hydrophilic groups are carboxylates and sulphonates, although other groups like sulfates, phosphonates, and the like can be used. A generic formula for the zwitterionic betaine surfactant to be used herein is: $R^1$–N+($R^2$)($R^3$)$R^4$X— wherein $R^1$ is a hydrophobic group; $R^2$ is hydrogen, $C_1$-$C_6$ alkyl, hydroxy alkyl or other substituted $C_1$-$C_6$ alkyl group; $R^3$ is $C_1$-$C_6$ alkyl, hydroxy alkyl or other substituted $C_1$-$C_6$ alkyl group which can also be joined to $R^2$ to form ring structures with the N, or a $C_1$-$C_6$ sulphonate group; $R^4$ is a moiety joining the cationic nitrogen atom to the hydrophilic group and is typically an alkylene, hydroxy alkylene, or polyalkoxy group containing from 1 to 10 carbon atoms; and X is the hydrophilic group, which is a carboxylate or sulphonate group.

Preferred hydrophobic groups $R^1$ are aliphatic or aromatic, saturated or unsaturated, substituted or unsubstituted hydrocarbon chains that can contain linking groups such as amido groups, ester groups. More preferred $R^1$ is an alkyl group containing from 1 to 24 carbon atoms, preferably from 8 to 18, and more preferably from 10 to 16. These simple alkyl groups are preferred for cost and stability reasons. However, the hydrophobic group $R^1$ can also be an amido radical of the formula Ra—C(O)—NH—$(C(Rb)_2)_m$, wherein Ra is an aliphatic or aromatic, saturated or unsaturated, substituted or unsubstituted hydrocarbon chain, preferably an alkyl group containing from 8 up to 20 carbon atoms, preferably up to 18, more preferably up to 16, Rb is selected from the group consisting of hydrogen and hydroxy groups, and m is from 1 to 4, preferably from 2 to 3, more preferably 3, with no more than one hydroxy group in any $(C(Rb)_2)$ moiety.

Preferred $R^2$ is hydrogen, or a $C_1$-$C_3$ alkyl and more preferably methyl. Preferred $R^3$ is $C_1$-$C_4$ sulphonate group, or a $C_1$-$C_3$ alkyl and more preferably methyl. Preferred $R^4$ is $(CH_2)_n$ wherein n is an integer from 1 to 10, preferably from 1 to 6, more preferably is from 1 to 3.

Suitable anionic surfactants to be used in the compositions herein include water-soluble salts or acids of the formula $ROSO_3M$ wherein R preferably is a $C_{10}$-$C_{24}$ hydrocarbyl, preferably an alkyl or hydroxyalkyl having a $C_{10}$-$C_{20}$ alkyl component, more preferably a $C_{12}$-$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like). Typically, alkyl chains of $C_{12-16}$ are preferred for lower wash temperatures (e.g., below 50° C.) and $C_{16-18}$ alkyl chains are preferred for higher wash temperatures (e.g., above 50° C.).

Other suitable anionic surfactants for use herein are water-soluble salts or acids of the formula $RO(A)_mSO_3M$ wherein R is an unsubstituted $C_{10}$-$C_{24}$ alkyl or hydroxyalkyl group having a $C_{10}$-$C_{24}$ alkyl component, preferably a $C_{12}$-$C_{20}$ alkyl or hydroxyalkyl, more preferably $C_{12}$-$C_{18}$ alkyl or hydroxyalkyl, A is an ethoxy or propoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines such as ethylamine, diethylamine, triethylamine, mixtures thereof, and the like. Exemplary surfactants are $C_{12}$-$C_{18}$ alkyl polyethoxylate (1.0) sulfate ($C_{12}$-$C_{18}$E(1.0)SM), $C_{12}$-$C_{18}$ alkyl polyethoxylate (2.25) sulfate ($C_{12}$-$C_{18}$E(2.25)SM), $C_{12}$-$C_{18}$ alkyl polyethoxylate (3.0) sulfate ($C_{12}$-$C_{18}$E(3.0)SM), and $C_{12}$-$C_{18}$ alkyl polyethoxylate (4.0) sulfate ($C_{12}$-$C_{18}$E(4.0)SM), wherein M is conveniently selected from sodium and potassium.

Other suitable anionic surfactants for use herein are sulphonated anionic surfactants Suitable sulphonated anionic surfactants for use herein include alkyl sulphonates, alkyl aryl sulphonates, naphthalene sulphonates, alkyl alkoxylated sulphonates, $C_6$-$C_{20}$ alkyl alkoxylated linear or branched diphenyl oxide disulphonates, or mixtures thereof. Suitable alkyl sulphonates for use herein include water-soluble salts or acids of the formula $RSO_3M$ wherein R is a $C_6$-$C_{20}$ linear or branched, saturated or unsaturated alkyl group, preferably a $C_8$-$C_{18}$ alkyl group and more preferably a $C_{14}$-$C_{17}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$-$C_{20}$ linear or branched saturated or unsaturated alkyl group, preferably a $C_8$-$C_{18}$ alkyl group and more preferably a $C_{10}$-$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

By "linear alkyl sulphonate" it is meant herein a non-substituted alkyl sulphonate wherein the alkyl chain comprises from 6 to 20 carbon atoms, preferably from 8 to 18 carbon atoms, and more preferably from 14 to 17 carbon atoms, and wherein this alkyl chain is sulphonated at one terminus.

Suitable alkoxylated sulphonate surfactants for use herein are according to the formula $R(A)_mSO_3M$ wherein R is an unsubstituted $C_6$-$C_{20}$ alkyl, hydroxyalkyl or alkyl aryl group, having a linear or branched $C_6$-$C_{20}$ alkyl component, preferably a $C_{12}$-$C_{20}$ alkyl or hydroxyalkyl, more preferably $C_{12}$-$C_{18}$ alkyl or hydroxyalkyl, A is an ethoxy or propoxy or butoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulphonates, alkyl butoxylated sulphonates as well as alkyl propoxylated sulphonates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines such as ethylamine, diethylamine, triethylamine, mixtures thereof, and the like. Exemplary surfactants are $C_{12}$-$C_{18}$ alkyl polyethoxylate (1.0) sulphonate ($C_{12}$-$C_{18}$E(1.0) SO3M), $C_{12}$-$C_{18}$ alkyl polyethoxylate (2.25) sulphonate ($C_{12}$-$C_{18}$E(2.25) SO3M), $C_{12}$-$C_{18}$ alkyl polyethoxylate (3.0) sulphonate ($C_{12}$-$C_{18}$E(3.0) SO3M), and $C_{12}$-$C_{18}$ alkyl polyethoxylate (4.0) sulphonate ($C_{12}$-$C_{18}$E(4.0) SO3M), wherein M is conveniently selected from sodium and potassium. Particularly suitable alkoxylated sulphonates include alkyl aryl polyether sulphonate like Triton X-200® commercially available from Union Carbide.

Other anionic surfactants suitable herein include sulfosuccinate surfactants, alkyl carboxylate surfactants, sulfosuccinamate surfactants and sulfosuccinamide surfactants.

Suitable alkyl carboxylate surfactants for use herein are according to the formula $RCO_2M$ wherein: R represents a hydrocarbon group selected from the group consisting of straight or branched alkyl radicals containing from 6 to 20, preferably 8 to 18, more preferably 10 to 16, carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

Other anionic surfactants useful for detersive purposes can also be used herein. These can include salts (including, for example, sodium, potassium, ammonium, and substituted ammonium salts such as mono-, di- and triethanolamine salts) of soap, sulphonated polycarboxylic acids prepared by sulphonation of the pyrolyzed product of alkaline earth metal citrates, e.g., as described in British patent specification No. 1,082,179, $C_8$-$C_{24}$ alkylpolyglycolethersulfates (containing up to 10 moles of ethylene oxide); alkyl ester sulphonates such as $C_{14-16}$ methyl ester sulphonates; acyl glycerol sulphonates, fatty oleyl glycerol sulfates, alkyl phenol ethylene oxide ether sulfates, alkyl phosphates, isethionates such as the acyl isethionates, N-acyl taurates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO^-M^+$ wherein R is a $C_8$-$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil.

Other suitable anionic surfactants to be used herein also include acyl sarcosinate, in its acid and/or salt form. Being derivatives of natural fatty acids, said acyl sarcosinates are rapidly and completely biodegradable and have good skin compatibility.

Optional Ingredients

The compositions herein may further comprise a variety of other optional ingredients such as chelating agents, builders, radical scavengers, antioxidants, bleach activators, soil suspenders polymers, catalysts, brighteners, pigments and dyes.

Chelating Agents

The bleaching compositions of the present invention may comprise a chelating agent as a highly preferred optional ingredient.

Suitable chelating agents may be any of those known to those skilled in the art, such as the ones selected from the group comprising phosphonate chelating agents, amino carboxylate chelating agents, other carboxylate chelating agents, polyfunctionally-substituted aromatic chelating agents, ethylenediamine N,N'-disuccinic acids, or mixtures thereof.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene. A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer, have been extensively described in U.S. Pat. No. 4,704,233, Nov. 3, 1987, to Hartman and Perkins. Ethylenediamine N,N'-disuccinic acid is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA), N-hydroxyethylethylenediamine triacetates, nitrilotri-acetates, ethylenediamine tetrapropionates, triethylenetetraamine-hexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

Particularly preferred chelating agents to be used herein are amino aminotri(methylene phosphonic acid), di-ethylene-triamino-pentaacetic acid, diethylene triamine penta methylene phosphonate, 1-hydroxy ethane diphosphonate, ethylenediamine N,N'-disuccinic acid, and mixtures thereof.

Typically, the bleaching compositions according to the present invention may comprise up to 5%, preferably from 0.01% to 1.5% by weight and more preferably from 0.01% to 0.5% by weight of the total composition of a chelating agent.

Preferably, the composition comprises less than 0.5% by weight of the total composition of a chelating agent, preferably less than 0.5% by weight of the total composition of HEDP.

Builder

The bleaching compositions of the present invention may further comprise one or more builders and/or a modified polycarboxylate co-builder.

Suitable builders are selected from the group consisting of: organic acids and salts thereof; polycarboxylates; and mixtures thereof. Typically said builders have a calcium chelating constant (pKCa) of at least 3. Herein the pKCa the value of a builder or a mixture thereof is measured using a 0.1M $NH_4Cl$—$NH_4OH$ buffer (pH 10 at 25° C.) and a 0.1% solution of said builder or mixture thereof with a standard calcium ion electrode.

Examples of builders are organic acids like citric acid, lactic acid, tartaric acid, oxalic acid, malic acid, monosuccinic acid, disuccinic acid, oxydisuccinic acid, carboxymethyl oxysuccinic acid, diglycolic acid, carboxymethyl tartronate, ditartronate and other organic acid or mixtures thereof. Suitable salts of organic acids include alkaline, preferably sodium or potassium, alkaline earth metal, ammonium or alkanolamine salts.

Such organic acids and the salts thereof are commercially available from Jungbunzlaur, Haarman & Reimen, Sigma-Aldrich or Fluka.

Other suitable builders include a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt or "overbased". When utilized in salt form, alkali metals, such as sodium, potassium, and lithium, or alkanolammonium salts are preferred. Useful polycarboxylates include homopolymers of acrylic acid and copolymers of acrylic acid and maleic acid.

Other useful polycarboxylate builders include the ether hydroxypolycarboxylates, copolymers of maleic anhydride with ethylene or vinyl methyl ether, 1,3,5-trihydroxy benzene-2,4,6-trisulfonic acid, and carboxymethyloxysuccinic acid, the various alkali metal, ammonium and substituted ammonium salts of polyacetic acids such as nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Suitable polycarboxylates are commercially available from Rohm & Haas under the trade name Norasol® or Acusol®.

Preferred builders herein are selected from the group consisting of: citric acid; tartaric acid; tartrate monosuccinate; tartrate disuccinate; lactic acid; oxalic acid; and malic acid; and mixtures thereof. Even more preferred builders herein are selected from the group consisting of: citric acid; tartaric acid; tartrate monosuccinate; tartrate disuccinate; and malic acid; and mixtures thereof. The most preferred builders herein are selected from the group consisting of: citric acid; tartaric acid; tartrate monosuccinate; and tartrate disuccinate; and mixtures thereof.

Typically the bleaching compositions herein may comprise up to 40%, preferably from 0.01% to 25%, more preferably from 0.1% to 15%, and most preferably from 0.5% to 10% by weight of the total composition of said builder.

The compositions of the present invention may further comprise a modified polycarboxylate co-builder. The term "polycarboxylate" refers to compounds having a plurality of carboxylate groups, preferably at least 3 carboxylates.

By "modified polycarboxylate" it is meant herein that at least at one end of the polycarboxylate compound, i.e., the polycarboxylate chain, said compound is modified by a functional group, e.g., a phosphono group. Preferred modified polycarboxylate co-builders are polycarboxylates with phosphono end groups. By "phosphono end group" it is meant herein a phosphono functional group according to the formula:

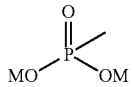

wherein each M is independently H or a cation, preferably both M are H.

Examples of suitable polycarboxylates with phosphono end groups are copolymers of acrylic acid and maleic acid having a phosphono end group and homopolymers of acrylic acid having a phosphono end group. Such modified polycarboxylate are available from Rohm & Haas under the trade name Acusol 425°, Acusol 420° or Acusol 470°.

Typically the bleaching compositions herein may comprise up to 40%, preferably from 0.01% to 25%, more preferably from 0.1% to 15%, and most preferably from 0.5% to 5% by weight of the total composition of said modified polycarboxylate co-builder.

Radical Scavengers

The compositions of the present invention may comprise radical scavenger or a mixture thereof. Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl)butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®. Radical scavengers when used, are typically present herein in amounts ranging from up to 10% by weight of the total composition, preferably from 0.001% to 2% and more preferably from 0.001% to 0.5% by weight.

The presence of radical scavengers may contribute to reduce tensile strength loss of fabrics and/or color damage when the compositions of the present invention are used in any laundry application, especially in a laundry pretreatment application.

Bleach Activators

As an optional ingredient, the compositions of the present invention may comprise a bleach activator or mixtures thereof. By "bleach activator", it is meant herein a compound which reacts with hydrogen peroxide to form a peracid. The peracid thus formed constitutes the activated bleach. Suitable bleach activators to be used herein include those belonging to the class of esters, amides, imides, or anhydrides. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. Finally, it provides good building capacity to the composition. The compositions according to the present invention may comprise from 0.01% to 20% by weight of the total composition of said bleach activator, or mixtures thereof, preferably from 1% to 10%, and more preferably from 3% to 7%

Process of Bleaching Fabrics

In another aspect, the present invention also encompass the process of bleaching fabrics using the above mentioned composition.

The liquid bleaching composition according to the present invention needs to be contacted with the fabrics to be bleached. This can be done either in a so-called "pretreatment mode", where the liquid composition is applied neat onto said fabrics before the fabrics are rinsed, or washed then rinsed, or in a "soaking mode" where the liquid composition is first diluted in an aqueous bath and the fabrics are immersed and soaked in the bath, before they are rinsed. The contact with fabrics can also be done in a "through the wash mode", where the liquid composition is added on top of a wash liquor formed by dissolution or dispersion of a typical laundry detergent.

It is essential in both cases, that the fabrics are rinsed after they have been contacted with said composition, before said composition has completely dried off.

In the pretreatment mode, the process comprises the steps of applying said liquid composition in its neat form onto said fabrics, or at least soiled portions thereof, and subsequently rinsing, or washing then rinsing said fabrics. In this mode, the neat compositions can optionally be left to act onto said fabrics for a period of time ranging from 1 minute to 1 hour, before the fabrics are rinsed, or washed then rinsed, provided that the composition is not left to dry onto said fabrics. For particularly though stains, it may be appropriate to further rub or brush said fabrics by means of a sponge or a brush, or by rubbing two pieces of fabrics against each other.

In another mode, generally referred to as "soaking mode", the process comprises the steps of diluting said liquid composition in its neat form in an aqueous bath so as to form a diluted composition. The dilution level of the liquid composition in an aqueous bath is typically up to 1:85, preferably up to 1:50 and more preferably 1:25 (composition:water). The fabrics are then contacted with the aqueous bath comprising the liquid composition, and the fabrics are finally rinsed, or washed then rinsed. Preferably in that embodiment, the fabrics are immersed in the aqueous bath comprising the liquid composition, and also preferably, the fabrics are left to soak therein for a period of time ranging from 1 minute to 48 hours, preferably from 1 hour to 24 hours.

In yet another mode which can be considered as a sub-embodiment of "soaking mode", generally referred to as "bleaching through the wash mode", the liquid composition is used as a so-called laundry additive. And in that embodiment the aqueous bath is formed by dissolving or dispersing a conventional laundry detergent in water. The liquid composition in its neat form is contacted with the aqueous bath, and the fabrics are then contacted with the aqueous bath containing the liquid composition. Finally, the fabrics are rinsed.

Depending on the end-use envisioned, the compositions herein can be packaged in a variety of containers including conventional bottles, bottles equipped with roll-on, sponge, brusher or sprayer.

EXAMPLES

Two liquid compositions were prepared. One according to the present invention (0.25% hydrogenated castor oil-crystalline hydroxyl-containing stabilizing agent), and one according to the present invention but not comprising a crystalline hydroxyl-containing stabilizing agent. Stability tests were conducted on samples stored for 2 weeks at 35° C. and 3 weeks at 30° C. In both cases no peroxide loss was seen. A rheology profile was measured for each liquid composition using a creep method. A TA Instrument Advanced Rheometer AR2000 was used to perform the test. The method involved a conditioning step to allow the test temperature of 20° C. to be reached, and an equilibration time of 1 minute. The creep was the conducted at 20° C. at a shear stress of $5.97\times10^{-3}$ Pa (equilibration time of 2 min). This was followed by a recovery step at 20° C. at a shear stress of $5.97\times10^{-3}$ Pa (equilibration time of 2 min). The analysis was conducted with 1 ml of sample. The results can be seen in FIG. 1. FIG. 1A shows the rheology profile of a liquid composition without any crystalline hydroxyl-containing stabilizing agent. The profile is a measure of strain against time (s) (global time (s)). FIG. 1B is the corresponding rheology profile for a liquid composition comprising a crystalline hydroxyl-containing stabilizing agent. From these profiles, zero shear viscosity can be calculated as the shear stress/the slope of the curve. From this value, sedimentation velocity can be calculated using Stokes law equation;

$$V_s = d_p^2 g(\rho_\mu - \rho_m)/18\eta_0$$

wherein, $V_s$=sedimentation velocity, $\eta_0$=zero shear viscosity, $d_p$=diameter particle, $\rho_\mu$=density particle, $\rho_m$=density medium, g=gravity acceleration.

For a 20 μm particle with a density of 1.009 g/ml (corresponding to a perfume microcapsule), the sedimentation velocity in the absence of a crystalline hydroxyl-containing stabilizing agent is −3 cm/month, whereas in the presence of a crystalline hydroxyl-containing stabilizing agent is −1 cm/month. The 'minus' values corresponds to the fact that the perfume microcapsule would 'float' to the surface due to the higher density of the matrix. Thus, in the presence of a crystalline hydroxyl-containing stabilizing agent, the sedimentation velocity is 3 times slower, increasing the stability of the composition.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid composition comprising peroxygen bleach, perfume microcapsules having a core and a shell that at least partially surrounds said core, a crystalline hydroxyl-containing stabilizing agent comprising a compound of the formula:

$$Z—(CH(OH))_a—Z'$$

wherein a is from 2 to 4, and Z and Z' are selected from $C_6$-$C_{20}$ alkyl or cycloalkyl, $C_6$-$C_{24}$ alkaryl or aralkyl, $C_6$-$C_{20}$ aryl and mixtures thereof, and more than about 10% of surfactant by weight of the total composition, wherein at least 75% of said microcapsules having a fracture strength of from 0.2 MPa to 10.0 MPa, and a microcapsule leakage of from 0% to 30%, and wherein a 20 μm diameter perfume microcapsule with a density of 1.009 g/ml that is present within said composition has a sedimentation velocity of -1 cm/month.

2. A composition according to claim 1 wherein the crystalline, hydroxyl-containing stabilizer agent comprises 1,4-di-O-benzyl-D-Threitol.

3. A composition according to claim 2 wherein the composition comprises from about 0.1% to about 10%, by weight of the total composition, of said 1,4-di-O-benzyl-D-Threitol.

4. Composition according to claim 1 wherein the perfume microcapsules comprise a polymeric outer shell made of the condensation of melamine and formaldehyde.

5. Composition according to claim 1 wherein the peroxygen bleach is selected from the group consisting of hydrogen peroxide; water-soluble sources of hydrogen peroxide; organic or inorganic peracids; hydroperoxides; and diacyl peroxides; and mixtures thereof.

6. Composition according to claim 5 wherein the composition comprises from about 0.1% to about 30% by weight of the total composition of said peroxygen bleach or a mixture thereof.

7. Composition according to claim 1 wherein the composition further comprises less than about 0.5% by weight of the total composition of a chelating agent, preferably less than about 0.5% by weight of the total composition of HEDP.

8. Composition according to claim 1 wherein the pH of said composition is from about 5 and about 9.

9. A process of treating fabrics with the composition defined in claim 1, wherein said process comprises the steps of contacting said fabrics with said liquid composition in its neat or diluted form and washing said fabrics with an aqueous bath comprising water and a conventional laundry detergent, before and/or during and/or after the step of contacting said fabrics with said liquid composition.

* * * * *